US005964036A

United States Patent [19]

Centofante

[11] Patent Number: 5,964,036

[45] Date of Patent: Oct. 12, 1999

[54] FOLDING KNIFE WITH SECONDARY LOCKING MECHANISM

[75] Inventor: Frank Anthony Centofante, Madisonville, Tenn.

[73] Assignee: Spyderco, Inc., Golden, Colo.

[21] Appl. No.: 08/968,204

[22] Filed: Nov. 12, 1997

[51] Int. Cl.[6] ..... B26B 1/04

[52] U.S. Cl. ..... 30/161; 30/155; 30/160

[58] Field of Search ..... 30/160, 161, 331

[56] References Cited

U.S. PATENT DOCUMENTS

| | | | |
|---|---|---|---|
| 749,230 | 1/1904 | Severance | 30/160 |
| 1,194,503 | 8/1916 | Jawoisch | 30/160 |
| 4,778,094 | 10/1988 | Glesser | 30/160 |
| 4,947,552 | 8/1990 | Barnes | 30/160 |
| 4,974,323 | 12/1990 | Cassady | 30/160 |
| 5,111,581 | 5/1992 | Collins | 30/160 |
| 5,425,175 | 6/1995 | Rogers | 30/161 |
| 5,495,674 | 3/1996 | Taylor, Jr. | 30/160 |
| 5,537,750 | 7/1996 | Seber et al. | 30/160 |
| 5,596,808 | 1/1997 | Lake et al. | 30/160 |

*Primary Examiner*—Rinaldi I. Rada
*Assistant Examiner*—Gyounghyun Bae
*Attorney, Agent, or Firm*—Sheridan Ross P.C.

[57] ABSTRACT

The present invention relates to cutting instruments, and more particularly folding knives which have a blade which travels between a first extended position coextensive with the knife handle and a second closed position with the knife blade at least partially recessed within a portion of the knife handle. More specifically, the present invention relates to secondary locking mechanisms to substantially prevent the knife blade from closing if the primary locking mechanism fails.

17 Claims, 8 Drawing Sheets

FOLDING KNIFE WITH SECONDARY LOCKING MECHANISM

FIELD OF THE INVENTION

The present invention relates to hand-held cutting instruments, primarily folding knives.

BACKGROUND OF THE INVENTION

Folding knives are commonly used by sportsmen, craftsmen and other individuals who desire a lightweight, hand-held cutting instrument which can be conveniently stored in a pocket or attached to a belt or other article of clothing with a clip. The folding feature of the knife substantially reduces the overall length and cumbersome nature of the knife as compared to fixed-blade knives. Additionally, during the storage of a folding knife, typically at least a portion of the knife blade is received in a cavity within the knife handle. This prevents the cutting edge of the knife blade from being exposed.

To use the knife blade, the blade is rotated at the point of attachment to the handle and extended outwardly, wherein the knife blade is positioned coextensive with the knife handle. In the extended position, the knife blade is generally "locked" into position by means of a spring-leaf locking arm positioned near the cavity of the knife handle which engages a heel end of the knife blade. Another common type of folding knife locking mechanism utilizes a "back lock" which has a biased arm near the rear of the handle which engages the heel portion of the knife blade when the knife blade is extended. Another type of primary locking mechanism used for folding knives is disclosed in U.S. Pat. No. 5,615,484 to Pittman, which discloses a cam mechanism centered at the point of rotation on the heel end of the blade. The cam mechanism is biased against a locking arm to prevent either the inadvertent opening or closing of a folding knife blade. Based on the design, however, the manufacturing of these types of primary locking mechanisms can be expansive and due to the constant frictional wear, susceptible to failure after extensive use.

Although there are numerous other folding knife primary locking mechanisms, all of them have the same problem of potentially failing after extensive or improper use. Any failure to the locking mechanism can create a danger to the user of the knife since the knife blade can close inadvertently and potentially injure the user. Thus, a significant need exists for a secondary safety locking mechanism which substantially prevents the closing of a knife blade of a folding knife if a failure exists with the primary locking mechanism.

SUMMARY OF THE INVENTION

It is thus an object of the present invention to provide a secondary safety mechanism to prevent the inadvertent closing of a folding knife blade from a first extended position to a second closed position. In one aspect of the present invention a stud is interconnected to a heel end of a folding knife blade. The stud extends outwardly from the knife blade and is positioned to contact a locking arm which is slidingly engaged to the folding knife handle. The locking arm is generally interconnected to a safety latch which may extend outwardly from the gripping surface of the knife handle to permit simplistic engagement by a user's fingers or thumb. Preferably, the stud is interconnected to the heel portion of the knife blade at a position which is off-center from the center of axis where the knife blade is interconnected to the folding knife handle.

It is another object of the present invention to provide a secondary safety mechanism for a folding knife which is cost effective to manufacture and which can be used on a variety of different types of folding knives without altering the shape or design of the knife blade or the primary locking mechanism. Thus, a stud is interconnected to a knife blade in a position slightly offset from the center of axis where the knife blade is interconnected to the knife blade, as opposed to utilizing costly cam systems. This simplistic design eliminates the need for blade modifications such as cut-outs and cams which can be costly to manufacture and susceptible to failure after significant wear.

In yet another aspect of the present invention a positive position latch mechanism is provided which allows the safety latch and interconnected stopping arm to be either positively engaged in the safety position or positively disengaged. This feature allows the user of the folding knife to determine by touch alone whether the folding knife secondary locking mechanism is in a locked or released position.

DETAILED DESCRIPTION

Figure 1:
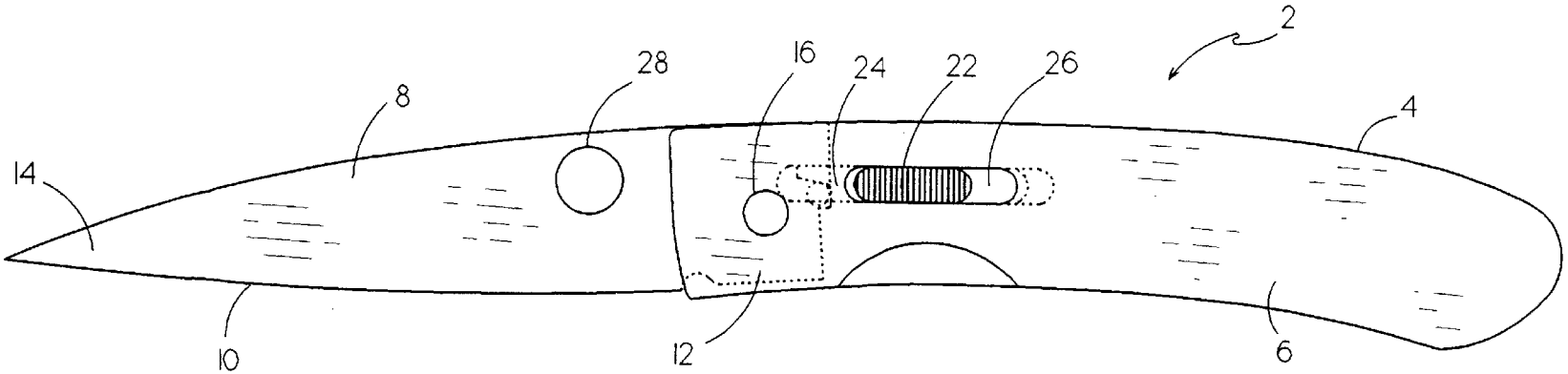
FIG. 1 is a front elevational view of a folding knife with secondary locking mechanism with the blade in an extended position.
Figure 2:
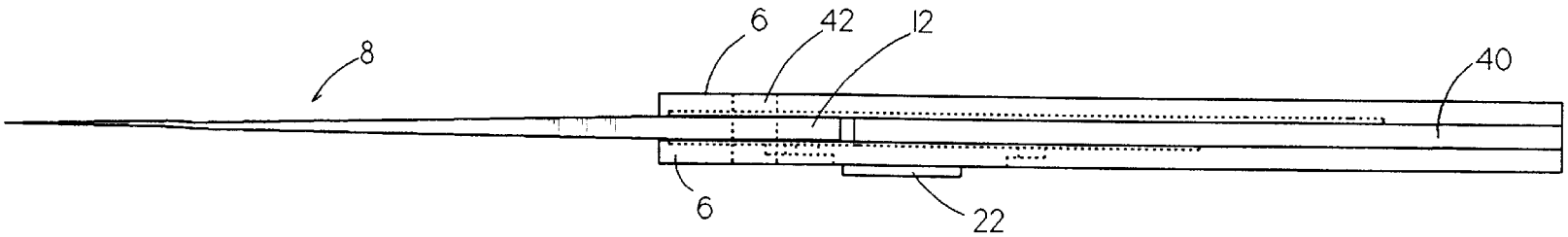
FIG. 2 is a top plan view of the folding knife shown in FIG. 1.

Referring now to the drawings, FIGS. 1 and 2 depict a folding knife 2 with secondary blade locking mechanism. In general, the folding knife 2 is comprised of a blade 8 interconnected to a handle 4 at a central point of rotation located near the blade heel end 12 at the blade aperture 16. A pin 42 extends through the blade aperture 16 and provides a point of rotation for the knife blade 8.

The secondary locking mechanism is generally comprised of a safety latch 22 which is interconnected to a safety locking arm 24. The safety locking arm 24 and safety latch 22 are slidingly interconnected to the knife handle 4 by an elongated slot 26 in the handle 4. When the safety locking arm 24 is moved forwardly toward the blade heel end 12 by means of the safety latch 22, a stud 20 interconnected to the knife blade 8 is engaged, thus preventing the knife blade from rotating downwardly towards the knife handle 4.

Figure 3:
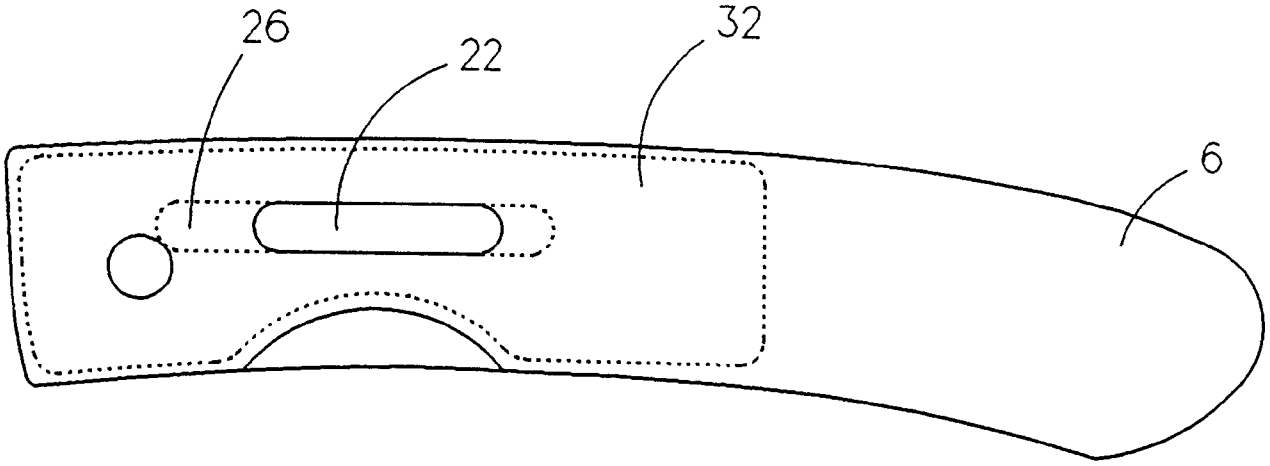
FIG. 3 is a front elevational view of the handle component used in the folding knife shown in FIG. 1.
Figure 4:
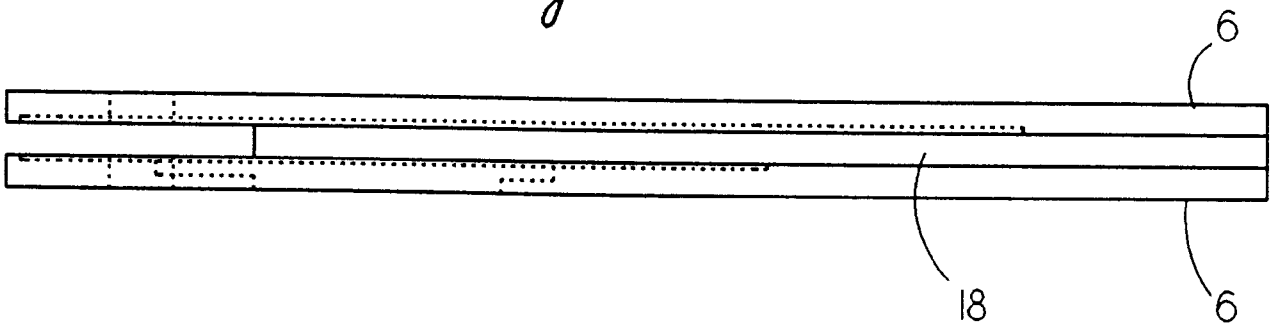
FIG. 4 is a top plan view of the handle shown in FIG. 3.

Referring now to FIGS. 3 and 4, the handle 4 portion of the folding knife 2 is shown in greater detail. More specifically, the handle 4 is generally comprised of two opposing gripping surfaces or scales 6. The scales 6 define a handle cavity 18 which is operably sized to receive at least the cutting edge 10 of the knife blade 8 when the knife blade is in a folded, closed position. The scales 6 may be comprised of wood, metal, plastic, nylon, zytel or any numerous type of materials which are durable and not susceptible to wear. An elongated slot 26 is located within one of the scales 6 to slidingly receive the safety locking arm 24 and safety latch 22 to permit travel of the safety locking arm 24 in a direction generally along the longitudinal axis of the knife handle 4.

Figure 5:
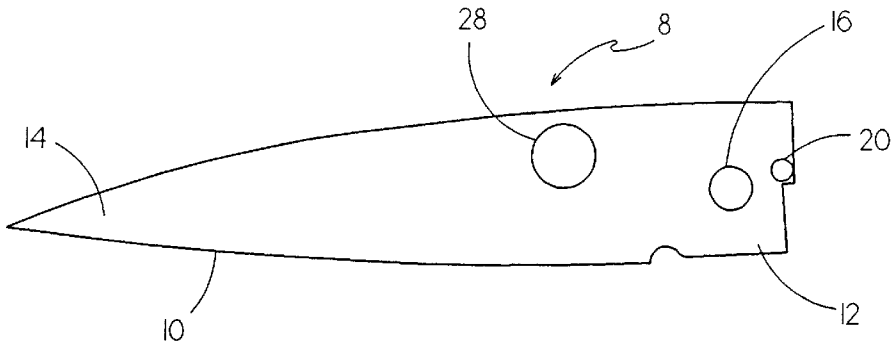
FIG. 5 is a front elevational view of the blade and stud used in the folding knife shown in FIG. 1.
Figure 6:
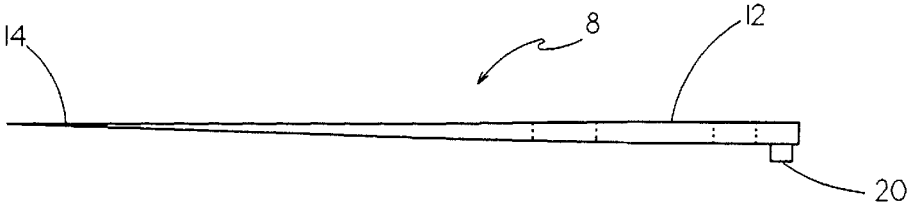
FIG. 6 is a top plan view of the blade shown in FIG. 5.

Referring now to FIGS. 5 and 6, a folding knife blade 8 is generally shown. The knife blade is comprised of a front end 14, a blade cutting edge 10 and a blade heel end 12. The blade heel end 12 has a blade aperture 16 for receiving a pin 42 upon which the blade 8 rotates and is interconnected to the knife handle 4. The blade heel end 12 additionally includes a stud 20 which extends outwardly from the longitudinal plane of the knife blade. This stud extends outwardly a sufficient distance to engage the safety locking arm 24 when the safety locking arm 24 is pushed forward by means of the safety latch 22 towards the heel end 12 of the knife blade. In the locked position the safety locking arm 24 is positioned immediately above the stud 20 and thus prevents the inadvertent closing of the knife blade 8. The stud 20 is generally concentric with a circular cross-sectional in shape although as appreciated by one skilled in the art numerous geometric configurations may be satisfactory for the intended purpose of engaging the safety locking arm 24.

As additionally identified in FIG. 5, a blade depression 28 is provided which in this particular diagram is circular. The depression 28 allows the folding knife 2 to be opened with one hand by the user applying force to the depression 28 while holding the knife handle 4. Any particular geometric shape may be used for the same purpose, including semi-circles, rectangles, or diamonds, to name a few. Alternatively, a thumb stud (not shown) may be used which projects outwardly from the knife blade and further allows a user to open the knife blade 8 with one hand.

Figure 7:
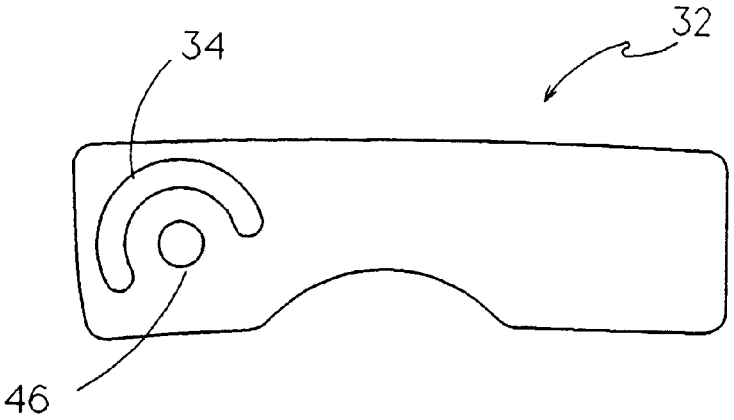
FIG. 7 is a front elevational view of a shim plate used in the folding knife of FIG. 1.
Figure 8:
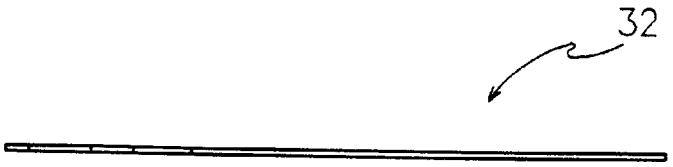
FIG. 8 is a top plan view of the shim plate shown in FIG. 7.

Referring now to FIG. 7 and 8, a shim plate 32 is shown independently of the other components of the folding knife 2. The shim plate 32 is positioned between the knife blade 8 and one of the scales 6 of the handle. The shim plate 32 is generally comprised of a metallic material such as stainless steel but any substantially rigid material such as fiberglass or plastic could be used. The shim plate 32 comprises a pin opening 46 for receiving the pin 42 which interconnects the folding knife handle 4 and the blade 8. Additionally, the shim plate 32 comprises a shim plate aperture 34 which in one embodiment is semi-circular shaped. The shim plate aperture 34 allows the stud 20 on the knife blade 8 to travel arcuately during rotation between a first extended position coextensive with the knife blade to a second closed position when the safety latch 22 is in a released position.

Figure 9:
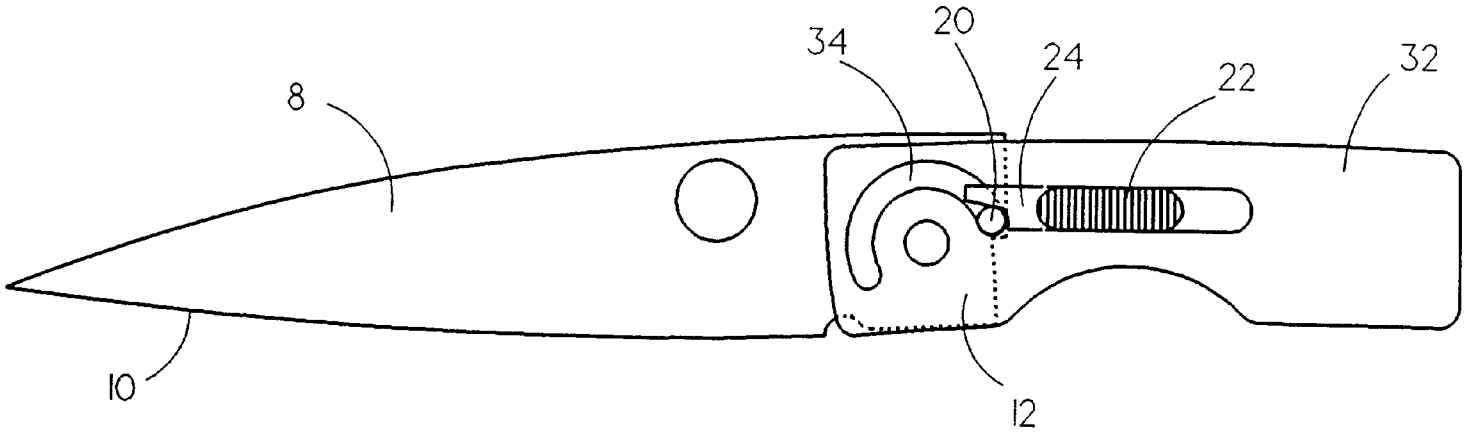
FIG. 9 is a front elevational view of the interconnected folding knife blade, shim plate and safety latch.
Figure 10:
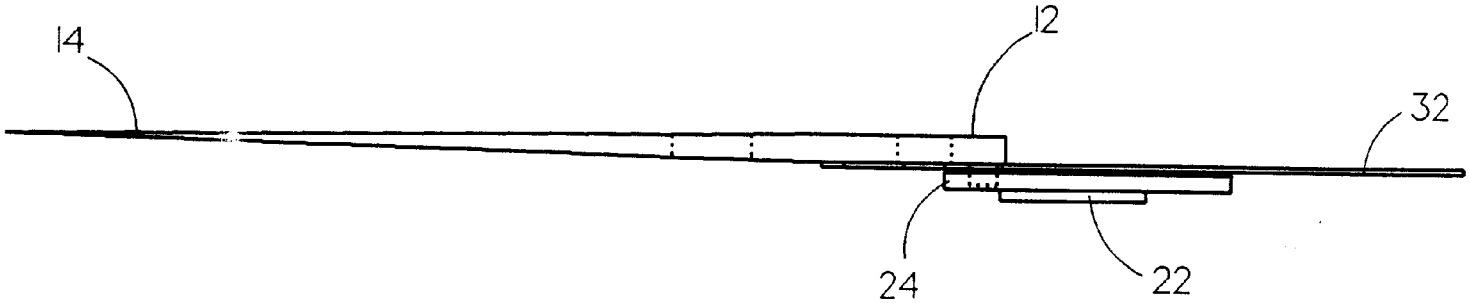
FIG. 10 is a top plan view of the components shown in FIG. 9.

Referring now to FIGS. 9 and 10, the interconnection of the knife blade 8, shim plate 32 and safety latch 22 with safety locking arm 24 is shown. As identified in the illustration, the shim plate 32 is positioned adjacent the knife blade heel end 12 while the shim plate aperture 34 receives the stud 20 to allow rotation of the knife blade 8 around the pin. When the safety locking arm 24 is in a forward position as shown, the safety locking arm 24 is positioned immediately above the stud 20. In this position, the blade is substantially prevented from rotating downwardly toward the handle cavity 18.

Figure 11:
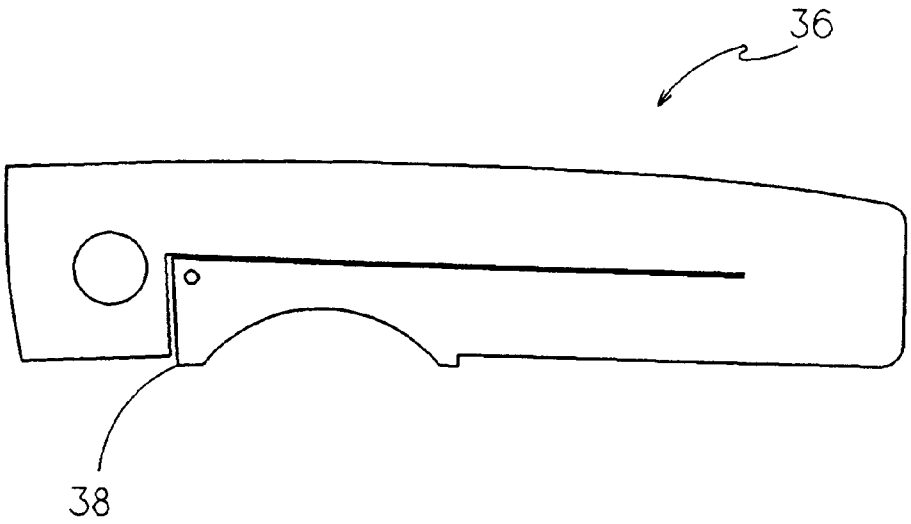
FIG. 11 is a front elevational view of a leaf spring primary locking assembly used in the folding knife of FIG. 1.
Figure 12:
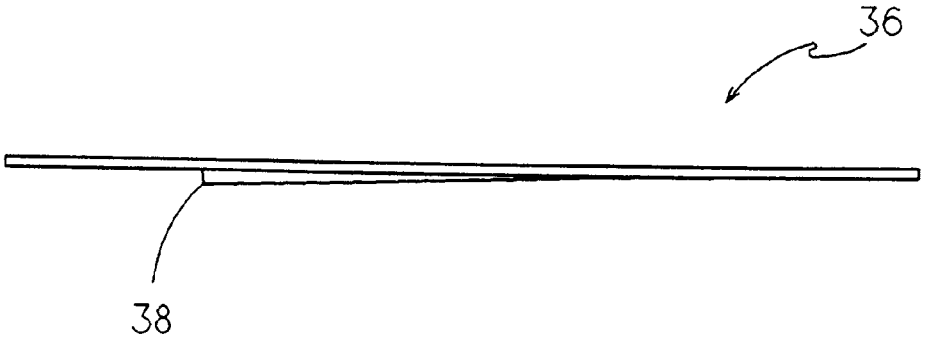
FIG. 12 is a top plan view of the leaf spring shown in FIG. 11.

Referring now to FIGS. 11 and 12, a leaf spring primary locking assembly 36 is shown. The leaf spring locking assembly 36 is one specific type of locking assembly commonly associated with folding knives, although there are numerous other types of locking mechanisms used in conjunction with folding knives. The leaf spring locking assembly 36 is generally interconnected to one of the scales 6 of the handle 4 and is positioned adjacent the handle cavity 18. A leaf spring stopping arm 38 is biased to extend into the knife cavity. Thus, when the knife blade is in a first extended position coextensive with the knife handle the stopping arm 38 engages the blade heel end 12, thus substantially preventing the knife blade 8 from closing.

Figure 13:
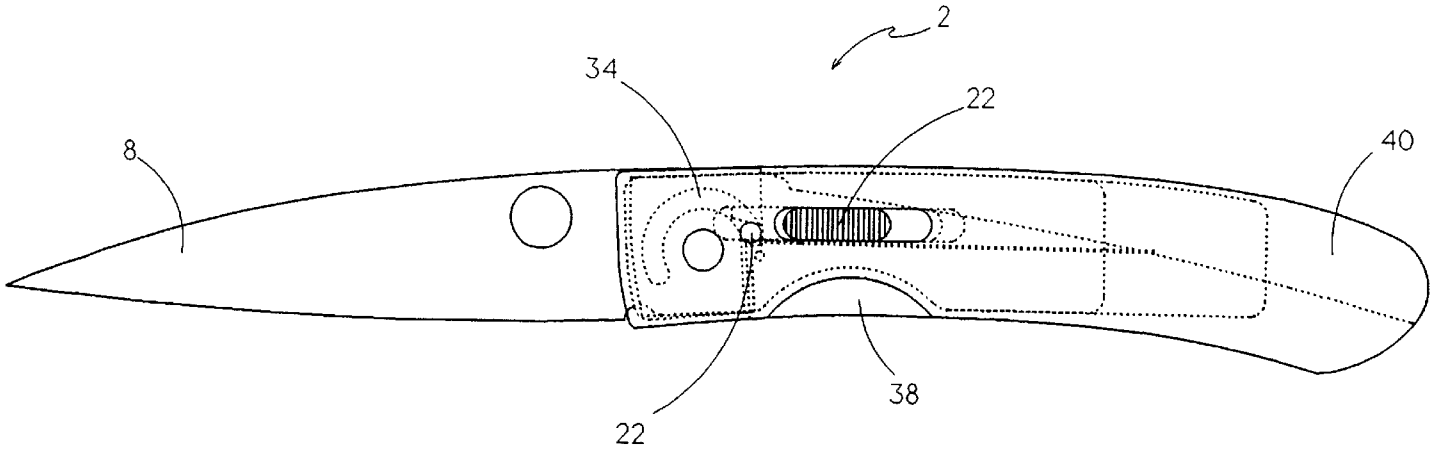
FIG. 13 is a front elevational view of the folding knife of FIG. 1, with hidden detail.
Figure 14:
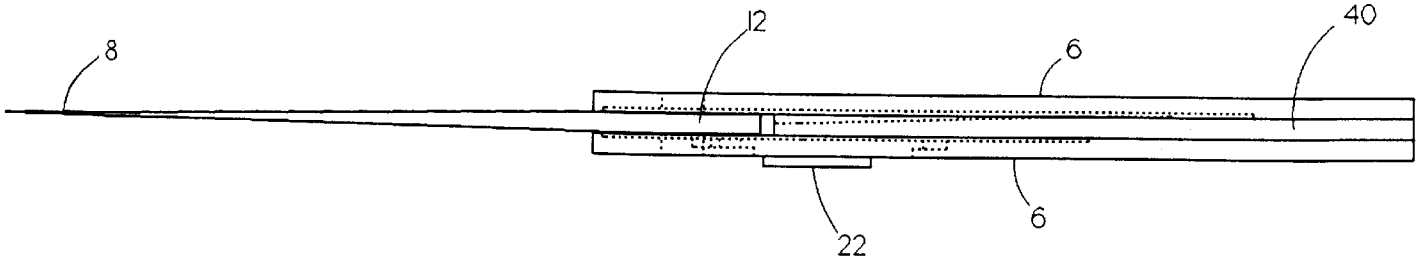
FIG. 14 is a top plan view of the folding knife shown in FIG. 13.

Referring now to FIGS. 13≧14, the interconnection of the knife blade 8, knife handle 4, safety latch 22 and other working components of the folding knife are shown. To provide a positive feel to the safety latch 22 and thus prevent the safety latch 22 from moving between a locked and released position inadvertently, frictional force is provided by pressure applied from the shim plate 32 acting on the safety locking arm 24 and biasing the safety locking arm 24 in the engagement slot 26. This frictional force makes it necessary for the user to provide a positive force to the safety latch 22 to move the locking arm 24 reversibly between a locked and released position. Alternatively, a detent ball (not shown) or other similar device known in the art could be used to prevent the safety latch 22 from moving independently between the locked and released position.

Figure 15:
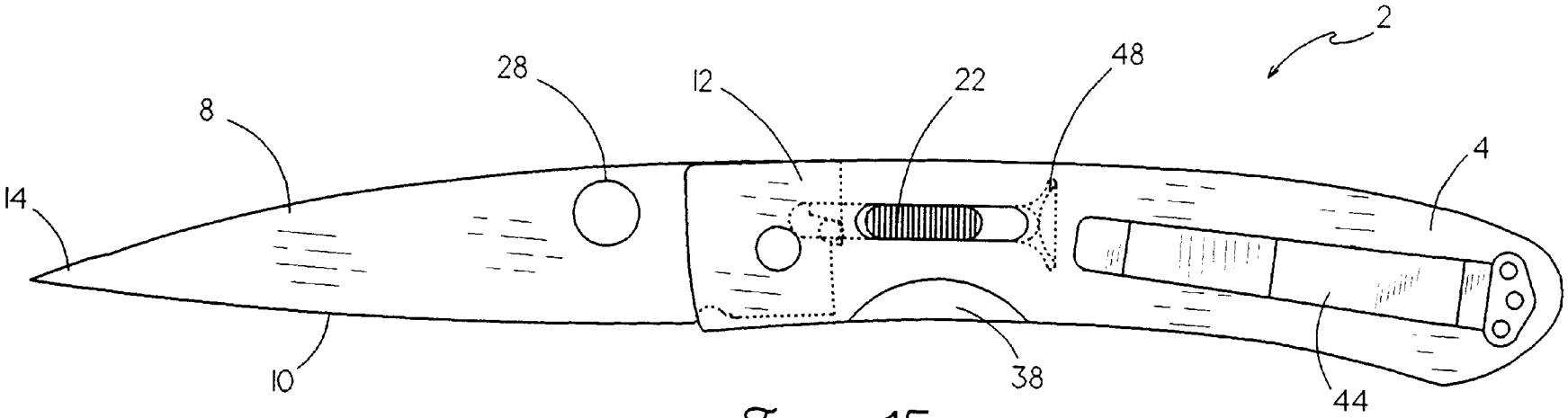
FIG. 15 is a front elevational view of the folding knife of FIG. 1 showing an alternative embodiment with a clip attached to the handle and a spring mechanism to bias the safety latch.

In an alternative embodiment shown in FIG. 15, a biasing spring 48 is used to provide a constant force against the safety locking arm 24 in a direction towards the knife blade heel end 12. Thus, the safety latch 22 will be in a locked position until a user forces the safety latch 22 in a direction opposite the blade pointed end 14, thus releasing the locking arm 24 from the stud 20. Preferably, the biasing spring 48 is comprised of a metallic band or leaf spring comprised of stainless steel or other similar material with sufficient resilient qualities.

In another embodiment shown in FIG. 15, a clip 44 is interconnected to a scale 6. The clip 44 is used to releasably interconnect the folding knife 2 to a user's trouser pocket, belt or other article of clothing. For reference and clarity purposes, the following is a list of the various components and corresponding numbering shown in the drawings:

| Component No. | Component |
|---|---|
| 02 | Folding Knife |
| 04 | Handle |
| 06 | Scale |
| 08 | Blade |
| 10 | Blade Cutting Edge |
| 12 | Blade Heel End |
| 14 | Blade Front End |
| 16 | Blade Aperture |
| 18 | Cavity |
| 20 | Stud |

-continued

| Component No. | Component |
|---|---|
| 22 | Safety Latch |
| 24 | Safety Locking Arm |
| 26 | Elongated Slot |
| 28 | Blade Depression |
| 30 | Handle Aperture |
| 32 | Shim Plate |
| 34 | Shim Plate Aperture |
| 36 | Leaf Spring Locking Assembly |
| 38 | Leaf Spring Stopping Arm |
| 40 | Handle Spacer |
| 42 | Pin |
| 44 | Clip |
| 46 | Shim Plate Pin Opening |
| 48 | Biasing Spring |

While various embodiments of the present invention have been described in detail, it is apparent that further modifications and adaptations of the invention will occur to those skilled in the art. However, it is to be expressly understood that such modifications and adaptations are within the scope of the present invention.

What is claimed is:

1. A folding knife with secondary locking mechanism to prevent the inadvertent closure of a knife blade, comprising:

a handle having opposing scales and a cavity therebetween;

said knife blade having a front end and a heel end, said heel end rotatably interconnected to said handle at a central point of rotation, wherein said knife blade travels between a first extended position coextensive with said handle and a second closed position with at least a portion of said knife blade received in said cavity;

a stud interconnected to said knife blade proximate to said heel end and offset from said central point of rotation of said blade, said stud extending outwardly from said knife blade;

a safety latch slidably interconnected to said handle and comprising a locking arm for releasable engagement with an outer circumference of said stud;

a substantially rigid shim plate positioned between said heel end of said blade and one of said scales, said shim plate having an arcuate cut-out portion for receiving said stud, wherein said knife blade may rotate between said first extended position and said second closed position when said safety latch is not in contact with said stud; and an elongated slot defined in one of said scales of said handle for receiving said safety latch and permitting said safety latch to travel between a first locked position and a second released position, wherein in said first locked position said knife blade is substantially locked in said first extended position coextensive with said handle.

2. The folding knife of claim 1, further comprising a spring means interposed within one of said scales and in operable contact with said safety latch for biasing said safety latch in a direction towards said heel end of said knife blade.

3. The folding knife of claim 2, wherein said spring means comprises a metallic band.

4. The folding knife of claim 1, further comprising friction means in operable contact with said safety latch or said locking arm, wherein said safety latch requires force from a user's finger to move said safety latch between said first locked position and said second released position.

5. The folding knife of claim 1, wherein said safety latch has an outer surface exposed above an outer surface of said scale for frictional engagement with a user's finger.

6. The folding knife of claim 1, further comprising a clip interconnected to said handle for attaching said folding knife to an object.

7. The folding knife of claim 1, further comprising a leaf spring interconnected to one of said scales proximate to said cavity, said leaf spring having a stopping arm within said cavity of said handle for securing said knife blade in said first extended position, said stopping arm operably biased to extend into said cavity when said knife blade is in said first extended position.

8. The folding knife of claim 1, wherein said stud has a substantially circular cross-sectional shape.

9. The folding knife of claim 1, wherein said safety latch and said locking arm travels between said first extended position and said second extended position in a plane offset from the plane of travel of said blade.

10. The folding knife of claim 1, wherein at least one of said scales has an arcuate shaped recess proximate to said heel end of said knife blade for receiving said stud as said knife blade travels between said first extended position and said second closed position.

11. The folding knife of claim 1, wherein said knife blade further comprises a depression for engaging a user's thumb or finger, wherein said knife blade can be opened with one hand.

12. The folding knife of claim 1, wherein said knife blade further comprises a thumb stud extending outwardly from said knife blade proximate to said knife blade heel end for engaging a user's thumb or finger, wherein said knife blade can be opened with one hand.

13. A folding knife with secondary locking mechanism, comprising:

a handle comprising opposing scales and a cavity therebetween;

a knife blade having a front end and a heel end, said heel end rotatably interconnected to said handle at a central point of rotation, wherein said knife blade travels between a first extended position coextensive with said handle and a second closed position with at least a portion of said knife blade received in said cavity;

a leaf spring with a stopping arm interconnected to said handle and positioned within said cavity of said handle for securing said knife blade in said first extended position, said stopping arm operably biased to extend into said cavity when said knife blade is in said first extended position;

a stud interconnected to said knife blade proximate to said heel end and offset from said central point of rotation of said knife blade, said stud extending outwardly from said knife blade and into an arcuate shaped recess positioned within said first scale;

a safety latch slidably interconnected to said first scale and interconnected to a locking arm for releasable engagement with an outer circumference of said stud;

a substantially rigid shim plate positioned between said heel end of said blade and one of said scales, said shim plate having an arcuate cut-out portion for receiving said stud, wherein said knife blade may rotate between said first extended position and said second closed position when said safety latch is not in contact with said stud; and an elongated slot defined between an outer surface of said first scale and said cavity for receiving said locking arm and permitting said safety latch and locking arm to travel between a first locked position and a second released position, wherein in said first locked position said knife blade is substantially locked in said first extended position coextensive with said handle.

14. The folding knife of claim 13, further comprising a spring means in contact with said locking arm for biasing said locking arm in a direction towards said heel end of said knife blade.

15. The folding knife of claim 13, further comprising a clip interconnected to said handle for attaching said folding knife to an object such as an article of clothing.

16. The folding knife of claim 13, wherein said knife blade further comprises a depression positioned proximate to an upper edge, wherein said knife blade can be opened with one hand by the user of said knife applying force to said depression with a finger or thumb.

17. The folding knife of claim 13, further comprising friction means in operable contact with said locking arm, wherein said safety latch requires force from a user's fingers to move said safety latch between said first locked position and said second released position.

* * * * *